US009306310B2

(12) United States Patent
Matsumura et al.

(10) Patent No.: US 9,306,310 B2
(45) Date of Patent: Apr. 5, 2016

(54) CONNECTOR

(71) Applicant: Yazaki Corporation, Minato-ku, Tokyo (JP)

(72) Inventors: Kaoru Matsumura, Makinohara (JP); Tomoyoshi Fukaya, Makinohara (JP); Kenji Kajikawa, Fujieda (JP)

(73) Assignee: Yazaki Corporation, Tokyo (JP)

( * ) Notice: Subject to any disclaimer, the term of this patent is extended or adjusted under 35 U.S.C. 154(b) by 6 days.

(21) Appl. No.: 14/371,282

(22) PCT Filed: Jan. 17, 2013

(86) PCT No.: PCT/JP2013/050828
§ 371 (c)(1),
(2) Date: Jul. 9, 2014

(87) PCT Pub. No.: WO2013/108846
PCT Pub. Date: Jul. 25, 2013

(65) Prior Publication Data

US 2015/0024639 A1 Jan. 22, 2015

(30) Foreign Application Priority Data

Jan. 19, 2012 (JP) ..... 2012-008833

(51) Int. Cl.
*H01R 13/436* (2006.01)

(52) U.S. Cl.
CPC ..... *H01R 13/4361* (2013.01); *H01R 13/4362* (2013.01)

(58) Field of Classification Search
CPC ..... H01R 13/42; H01R 13/4223; H01R 13/4361; H01R 13/4362; H01R 13/62; H01R 13/6273; H01R 2201/26
See application file for complete search history.

(56) References Cited

U.S. PATENT DOCUMENTS 7,988,502 B2 * 8/2011 Nagano ..... H01R 13/424 439/595
8,215,987 B2 * 7/2012 Yoshioka ..... H01R 13/4362 439/587

(Continued)

FOREIGN PATENT DOCUMENTS

CN 1574481 A 2/2005
CN 1697263 A 11/2005

(Continued)

OTHER PUBLICATIONS

International Search Report of PCT/JP2013/050828 dated Apr. 9, 2013 [PCT/ISA/210].

(Continued)

*Primary Examiner* — Truc Nguyen
(74) *Attorney, Agent, or Firm* — Sughrue Mion, PLLC

(57) ABSTRACT

A connector is provided which includes a housing in which a terminal is accommodated, and a retainer which is mounted on the housing to prevent movement of the terminal in the direction of detachment. A retainer insertion hole is provided on the housing to insert the retainer, and a provisional locking projection and a final locking projection are provided which extend into the retainer insertion hole. A guide portion is provided in the retainer which is flexibly deformed by interference from the provisional locking projection and the final locking projection, and a locked portion is formed, which is a locking hole opened in the guide portion. The locked portion and the provisional locking projection are temporarily locked during the insertion process, and the locked portion and the final locking projection are locked at the end of the insertion process.

5 Claims, 14 Drawing Sheets

(56) References Cited

U.S. PATENT DOCUMENTS

| | | | | |
|---|---|---|---|---|
| 8,485,836 | B2 * | 7/2013 | Nakamura | H01R 13/4223 439/188 |
| 2002/0123260 | A1 * | 9/2002 | Ichio | H01R 13/4361 439/352 |
| 2002/0187676 | A1 * | 12/2002 | Kurimoto | H01R 13/4362 439/595 |
| 2002/0193013 | A1 * | 12/2002 | Mase | H01R 13/4362 439/752 |
| 2003/0054690 | A1 * | 3/2003 | Fukatsu | H01R 43/16 439/595 |
| 2003/0096539 | A1 * | 5/2003 | Ichio | H01R 13/4362 439/752 |
| 2004/0106332 | A1 * | 6/2004 | Kurimoto | H01R 13/4362 439/752 |
| 2004/0175994 | A1 * | 9/2004 | Kayama | H01R 13/7031 439/686 |
| 2004/0253882 | A1 | 12/2004 | Fukatsu et al. | |
| 2005/0255756 | A1 | 11/2005 | Tanaka et al. | |

FOREIGN PATENT DOCUMENTS

| | | | |
|---|---|---|---|
| CN | 101436726 | A | 5/2009 |
| EP | 0644619 | A2 | 3/1995 |
| EP | 1052733 | A1 | 11/2000 |
| JP | 55-93979 | U | 6/1980 |
| JP | 63-48782 | A | 3/1988 |
| JP | 2005-327503 | A | 11/2005 |

OTHER PUBLICATIONS

Communication dated Jul. 14, 2015 from the Japanese Patent Office in counterpart application No. 2012-008833.

Communication dated Jul. 17, 2015 from the European Patent Office in counterpart European Application No. 13739127.2.

Communication dated Nov. 3, 2015 from the State Intellectual Property Office of the P.R.C. in counterpart application No. 201380006049.1.

Communication dated Nov. 4, 2015 from the Japanese Patent Office issued in corresponding Japanese application No. 2012-008833.

* cited by examiner (a)

(b)

CONNECTOR

TECHNICAL FIELD

The present invention relates to a connector with a retainer to prevent terminals from being detached.

BACKGROUND ART

Existing connectors with a retainer to prevent terminals from being detached include a connector disclosed in Patent Literature 1. As illustrated in FIGS. 13 to 16, the connector 50 includes a housing 51 containing terminals 70 and a retainer 60 which is mounted on the housing 51 to prevent the terminals 70 from moving in the direction of detachment.

The housing 51 includes a housing body portion 52, a bending space S on the left and right outer sides of the housing body portion 52, and a pair of reinforcing beam portions 53 provided integrally with the housing body portion 52 with the bending space S in between. The housing body portion 52 includes a connector fitting chamber (not illustrated) into which a mating connector is fitted and two terminal cavities 54 opened in the innermost position in the connector fitting chamber (not illustrated). Each of the terminal cavities 54 receives a terminal 70 inserted from the side opposite to the connector fitting chamber (not illustrated). The terminals 70 fully inserted in the terminal cavities 54 are prevented from moving in the direction of detachment by a lance (not illustrated) on a side of the housing body portion 52. The terminal 70 received in the terminal cavity 54 projects its mating contact portion (not illustrated) into the connector fitting chamber (not illustrated).

A retainer insertion hole 55 that is opened at the two terminal cavities 54 from above is provided in the housing body portion 52. A pair of provisional locking projections 56 and a pair of final locking projections 57 which project at the left and right positions of the retainer insertion hole 55 are provided in the housing body portion 52.

The retainer 60 includes a retainer may body 61 and a pair of elastic arms 62 which is vertically suspended from both sides of the retainer main body 61 and can bend and deform. Two terminal locking portions 61*a* are provided in the retainer main body 61. A locking claw 62*a* projecting from the inner surface of the tip of each of the elastic arms 62 is provided in each of the elastic arms 62.

A procedure for attaching terminals to the housing 51 will now be described. First, the retainer 60 is inserted into the retainer insertion hole 55 from above the housing 51 as illustrated in FIG. 14. Then, the pair of locking claws 62*a* of the retainer 60 interferes with each of the provisional locking projections 56 of the housing 51, but each of the elastic arms 62 bends and deforms by a reactive force from each of the provisional locking projections 56 to allow insertion of the retainer 60. When the retainer 60 is inserted to a position where the locking claws 62*a* thereof override the provisional locking projections 56, the elastic arms 62 bends and restores the deformation. Thereby, each of the locking claws 62*a* of the retainer 60 is locked at the provisional locking projection 56 of the housing 51 as illustrated in FIG. 15. Thus, the retainer 60 is provisionally locked. At the provisional locking position, the respective terminal locking portions 61*a* of the retainer 60 are located at a position before entering the terminal cavities 54.

Then, the terminals 70 are inserted into the depth of the terminal cavities 54. When the terminals 70 are fully inserted, the lance (not illustrated) prevents movement in the direction of detachment.

Then, the retainer 60 is into the depth of the retainer insertion hole 55. Then, each of the locking claws 62*a* of the retainer 60 interferes with each of the final locking projections 57 of the housing 51, but each of the elastic arms 62 bends and deforms by a reactive force from each of the final locking projections 57 to allow insertion of the retainer 60. When the retainer 60 is inserted to a position where the pair of locking claws 62*a* overrides each of the final locking projections 57, each of the elastic arms 62 bends and restores the deformation. Thereby, each of the locking claws 62*a* of the retainer 60 is locked at the final locking projections 57 of the housing 51 as illustrated in FIG. 16. Thus, the retainer 60 is finally locked. At the final locking position, each of the terminal locking portions 61*a* of the retainer 60 enters each of the terminal cavities 54 to prevent the movement of the terminals 70 in the direction of detachment.

In this conventional example, detachment of the terminals 70 can be reliably prevented because the terminals 70 are doubly locked by the lance (not illustrated) and the retainer 60.

CITATION LIST

Patent Literature

[Patent Literature 1] Japanese Patent Application Laid-Open Publication No. 2005-327503

SUMMARY OF INVENTION

Technical Problem

However, since the locking structure on the retainer 60 side of the connector 50 of the conventional example is constituted by the elastic arms 62 and the locking claws 62*a*, the locking structure on the retainer 60 side has a large width dimension W2. The provisional locking projection 56 and the final locking projection 57 bend and deform from the front end position of the provisional locking projection 56 and the final locking projection 57 by a distance equal to the width dimension W2 of the elastic arm 62 and the locking claw 62*a*. Accordingly, a large bending deformation clearance Z2 (illustrated in FIGS. 15 and 16) needs to be provided for the elastic arms 62 and locking claws 62*a*. Because of the large bending deformation clearances Z2, the connector 50 is large in size.

In order to reduce the size of the connector 50, the dimensions of projections of the provisional locking projections 56 and the final locking projections 57 and the dimensions of projections of the locking claws 62*a* of the elastic arms 62 can be reduced. However, such a structure cannot be used because the structure reduces the force to lock and hold the retainer 60 in the housing 51 and consequently the retainer 60 can be moved or come off due to vibrations during transportation of the connector or other causes.

The present invention has been made in order to solve the problem described above and an object of the present invention is to provide a smaller connector by reducing bending deformation clearances in a retainer.

Solution to Problem

The present invention provides a connector including a housing in which a terminal is accommodated and a retainer which is mounted on the housing to prevent the terminal from moving in the direction of detachment, wherein a retainer insertion hole through which the retainer is inserted, and a provisional locking projection and a final locking projection which project into the retainer insertion hole are provided in the housing, a bending deformation portion which bends and deforms by interference with each of the provisional locking projection and the final locking projection is provided in the retainer, and a locked portion is provided in the bending deformation portion, wherein the locked portion and the provisional locking projection are locked together to be brought into a provisional locking state in an intermediate insertion position of the retainer into the retainer insertion hole, and the locked portion and the final locking projection are locked together to be brought into a final locking state in an insertion completion position of the retainer into the retainer insertion hole, and wherein the locked portion is formed as a locking hole opened in the bending deformation portion.

The bending deformation portion is preferably a guide portion provided continuously to the retainer main body.

In the guide portion, a beam portion surrounding the locking hole is formed thinner than the rest of the guide portion.

DESCRIPTION OF EMBODIMENTS

A first embodiment of the present invention will be described below with reference to drawings.

First Embodiment

FIGS. 1 to 11 illustrate the first embodiment of the present invention. A connector 1 includes a housing 2 in which terminals (not illustrated) are accommodated and a retainer 20 which is mounted on the housing 2 to prevent movement of the terminals (not illustrated) in the direction of detachment.

Figure 1:
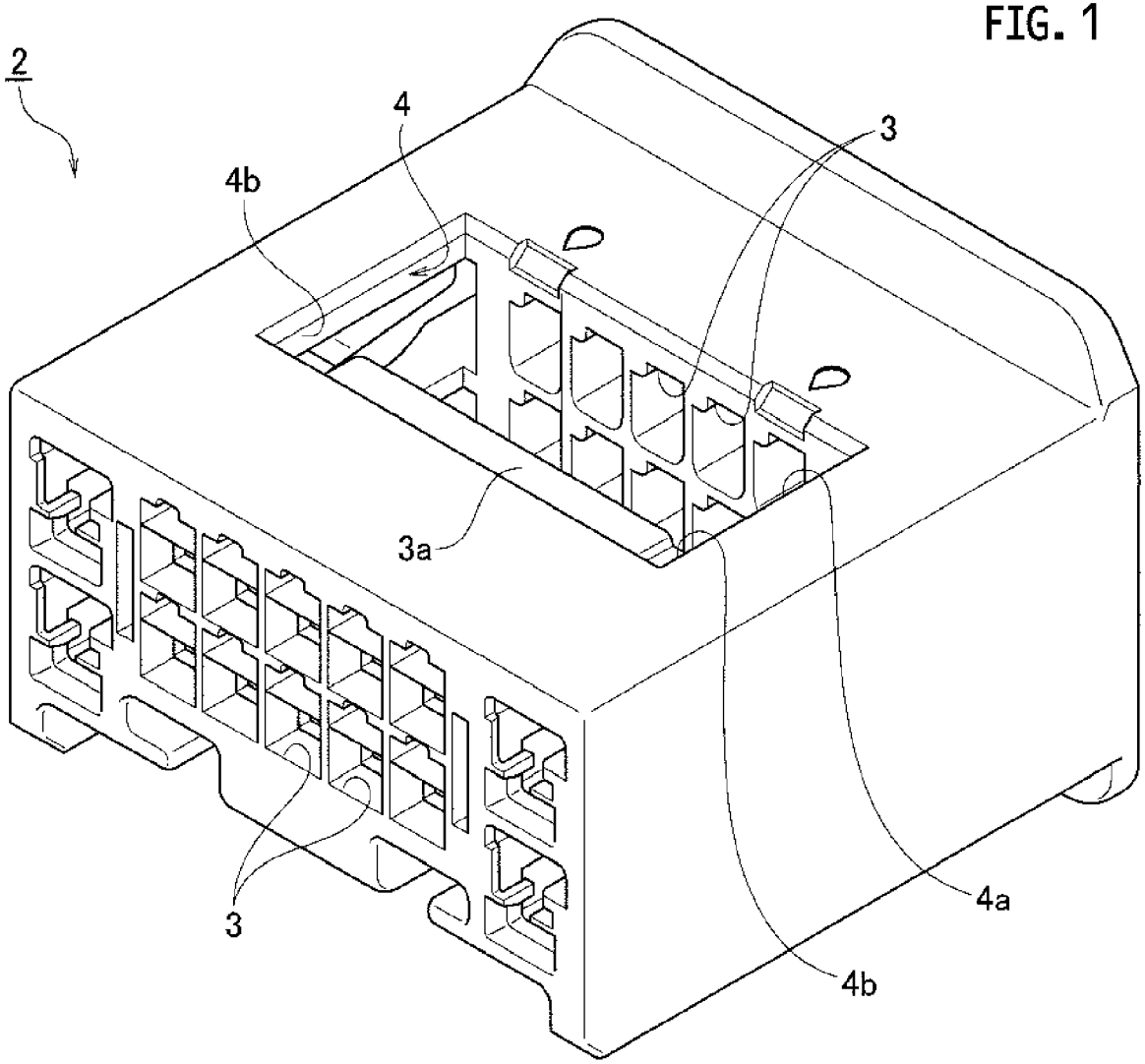
FIG. 1 illustrates a first embodiment of the present invention and is a perspective view of a housing.
Figure 2:
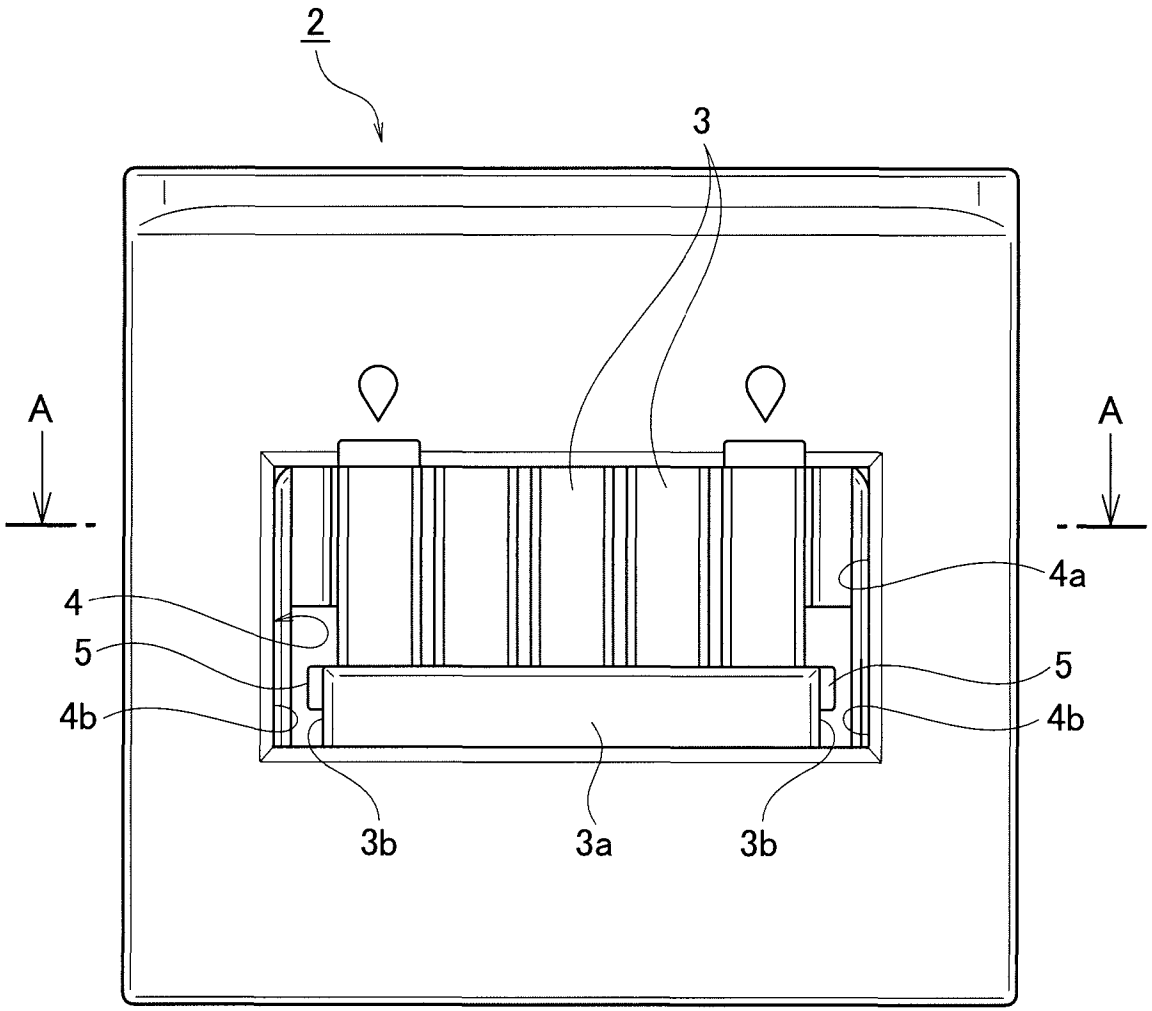
FIG. 2 illustrates the first embodiment of the present invention and is a plan view of the housing.
Figure 3:
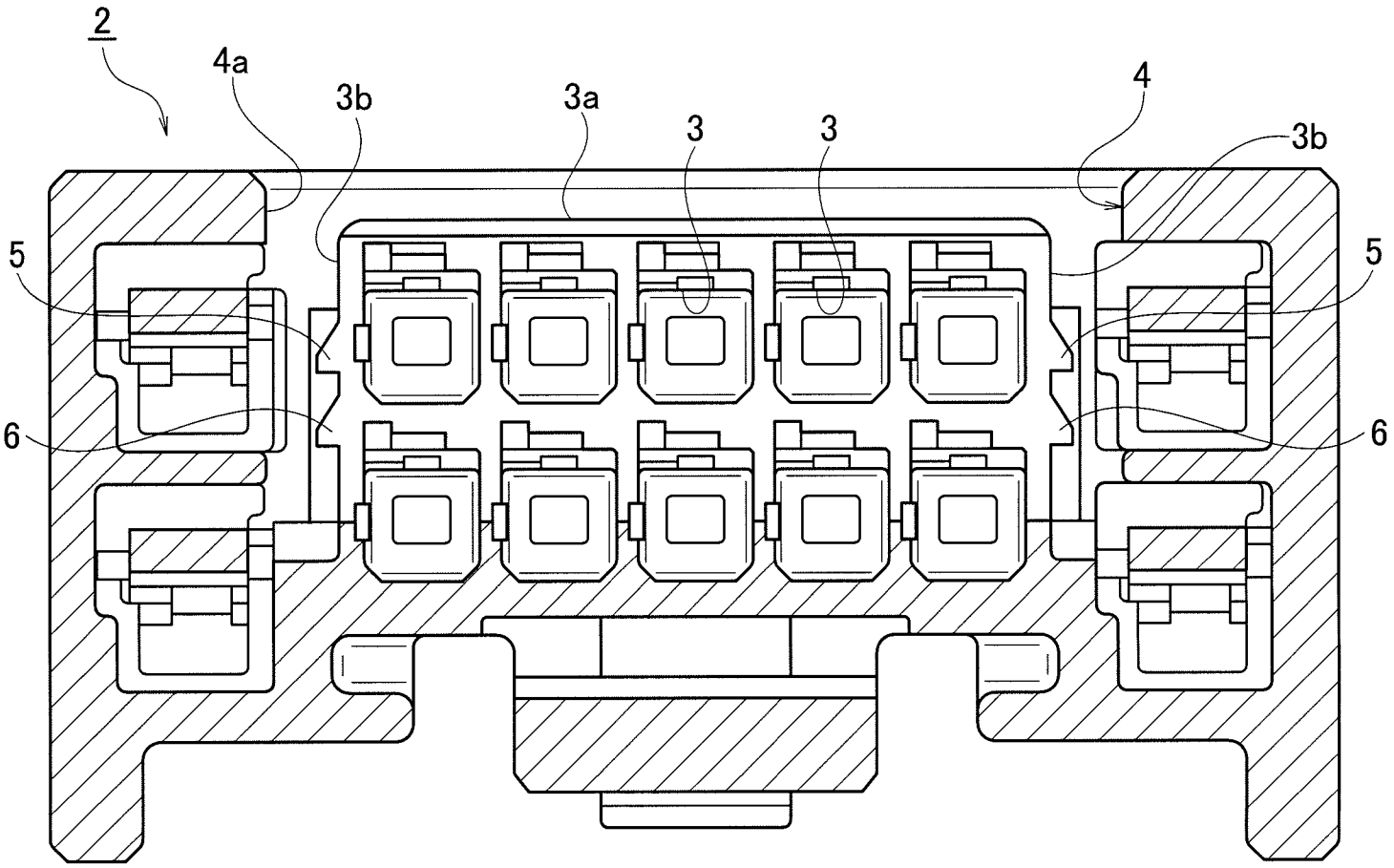
FIG. 3 illustrates the first embodiment of the present invention and is a cross-sectional view taken along line A-A of FIG. 2.

As illustrated in FIGS. 1 to 3, the housing 2 includes a connector fitting chamber (not illustrated) into which a mating connector is to be fitted and a plurality of terminal cavities 3 opened in the innermost position of a connector fitting chamber (not illustrated) and arranged in two rows. The connector fitting chamber (not illustrated) is opened in the front surface of the housing 2. A lance (not illustrated) formed integrally with the housing 2 projects into each of the terminal cavities 3. Each of the terminal cavities 3 receives a terminal inserted from the side opposite to the connector fitting chamber (not illustrated). The terminal (not illustrated) received in the terminal cavity 3 projects its mating contact portion (not illustrated) into the connector fitting chamber (not illustrated).

A retainer insertion hole 4 opened at the top surface of the housing 2 is provided in the housing 2. The retainer insertion hole 4 is constituted by a retainer main body insertion hole 4*a* and a pair of guide portion insertion holes 4*b*, which is a pair of bending deformation portion insertion holes, provided continuously to the retainer main body insertion hole 4*a*. The terminal cavities 3 in the upper row and the top walls of the terminal cavities 3 in the lower row are cut out in most locations corresponding to the retainer main body insertion hole 4*a*. Accordingly, the retainer main body insertion hole 4*a* extends completely through all of the terminal cavities 3 in the upper row and the top walls of all of the terminal cavities 3 in the lower row. The terminal cavities 3 in the two rows are disposed in a location corresponding to the region between the pair of guide portion insertion holes 4*b* in the retainer main body insertion hole 4*a*. The top surface constituting the terminal cavities 3 in the two rows are formed as a retainer insertion restricting surface 3*a*. The left and right side surfaces constituting the terminal cavities 3 in the two rows are formed as a pair of guide surfaces 3*b*.

Provisional locking projections 5 and final locking projections 6 are successively provided along the vertical direction of each of the pair of guide surfaces 3*b*. The provisional locking projections 5 and the final locking projections 6 are projected in symmetrical positions in the pair of guide portion insertion holes 4*b*. The provisional locking projections 5 are disposed above the final locking projections 6. Each of the provisional locking projections 5 and the final locking projections 6 has a tapered surface projecting outward from top toward bottom and the lower surface is formed as a vertical surface.

Figure 4:
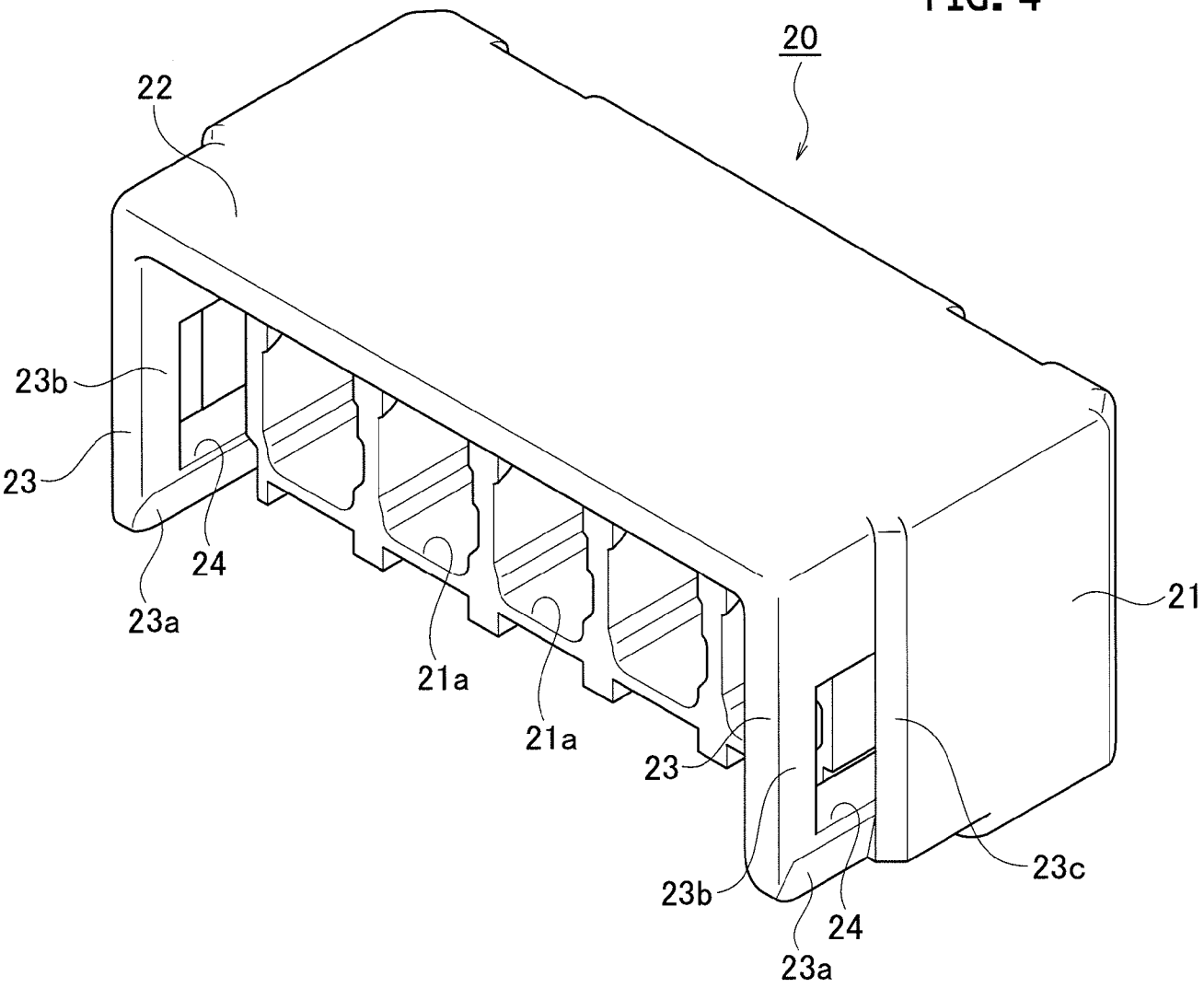
FIG. 4 illustrates the first embodiment of the present invention and is a perspective view of a retainer.
Figure 5:
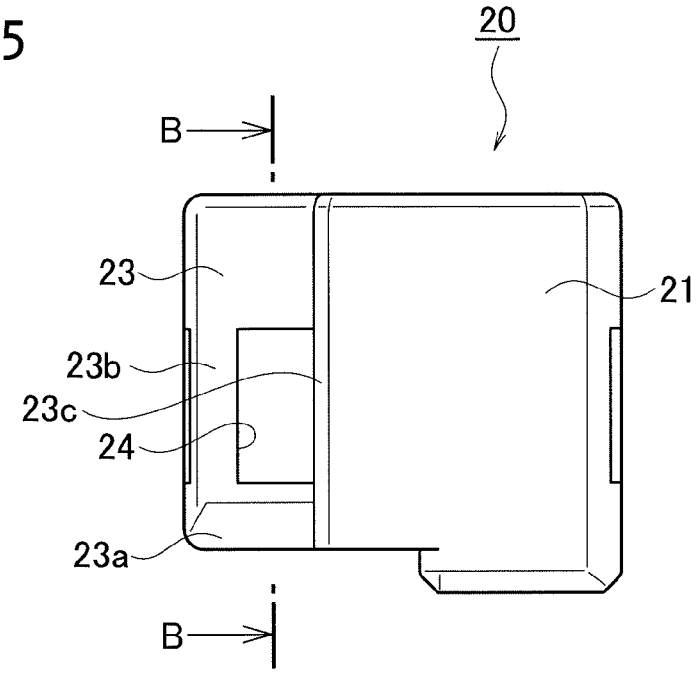
FIG. 5 illustrates the first embodiment of the present invention and is a side view of the retainer.
Figure 6:
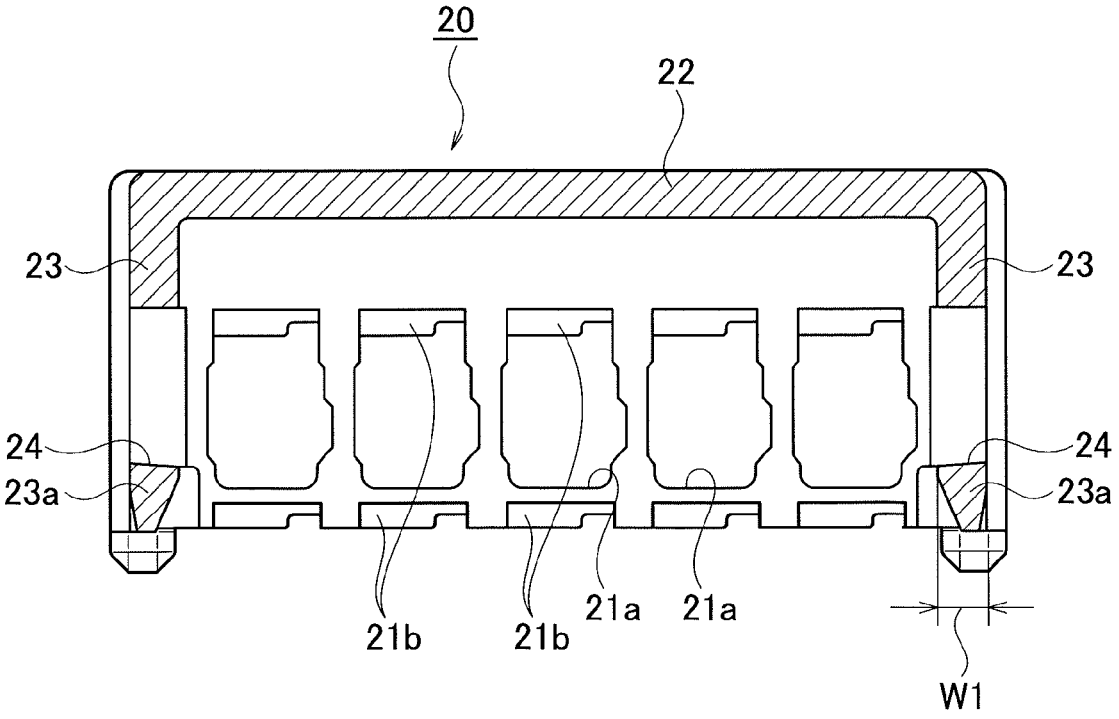
FIG. 6 illustrates the first embodiment of the present invention and is a cross-sectional view taken along line B-B of FIG. 5.

As illustrated in FIGS. 4 to 6, the retainer 20 includes a retainer main body 21, atop surface restricting wall 22 provided continuously to the upper wall of the retainer main body 21, and guide portions 23 which are a pair of bending deformation portions provided continuously to both of the lower ends of the sides of the top surface restricting wall 22 and the sidewalls of the retainer main body 21.

The retainer main body 21 includes auxiliary terminal cavities 21*a* corresponding to the terminal cavities 3 in the upper row and includes a plurality of terminal locking portions 21*b* in positions corresponding to the terminal cavities 3 in the two rows. The auxiliary terminal cavities 21*a* complement the cut out terminal cavities 3 when the retainer 20 is at the housing mounting position. The terminal locking portions 21*b* are located in the terminal cavities 3 in the two rows to prevent the terminals (not illustrated) from moving in the direction of detachment when the retainer 20 is at the housing mounting position.

The top surface restricting wall 22 abuts on the retainer insertion restricting surface 3*a* when the retainer 20 is mounted. This allows the retainer 20 to be mounted in the retainer insertion hole 4 at a proper insertion depth.

The distance between the pair of guide portions 23 is set to the distance of the pair of guide surfaces 3*b*. This allows the retainer 20 to be inserted in the retainer insertion hole 4 while the pair of guide portions 23 is guided by the pair of guide surfaces 3*b*. The pair of guide portions 23 is made thinner than the sidewalls of the retainer main body 21. This sets the pair of guide portions 23 so as to be able to bend and deform to override the provisional locking projections 5 and the final locking projections 6.

A locking hole 24, which is a locked portion, is provided in each of the guide portions 23. Each locking hole 24 is a rectangular hole opened in the direction in which the guide portion 23 bends and deforms. Each locking hole 24 is not opened at the edge face of the guide portion 23 but is surrounded by a closed-loop hole inner surface. Accordingly, although the locking holes 24 are opened, a high rigidity of each guide portion 23 is maintained by double-supported beam portions 23*b*, 23*c*. The beam portion 23*b* is formed by the guide portion 23 while the beam portion 23*c* is formed by a portion of the retainer main body 21 that is continuous to the guide portions 23.

The front end side of each guide portion 23 beyond the locking hole 24 is an insertion front end portion 23*a*. The inner surface of the insertion front end portion 23*a* is tapered.

Figure 7:
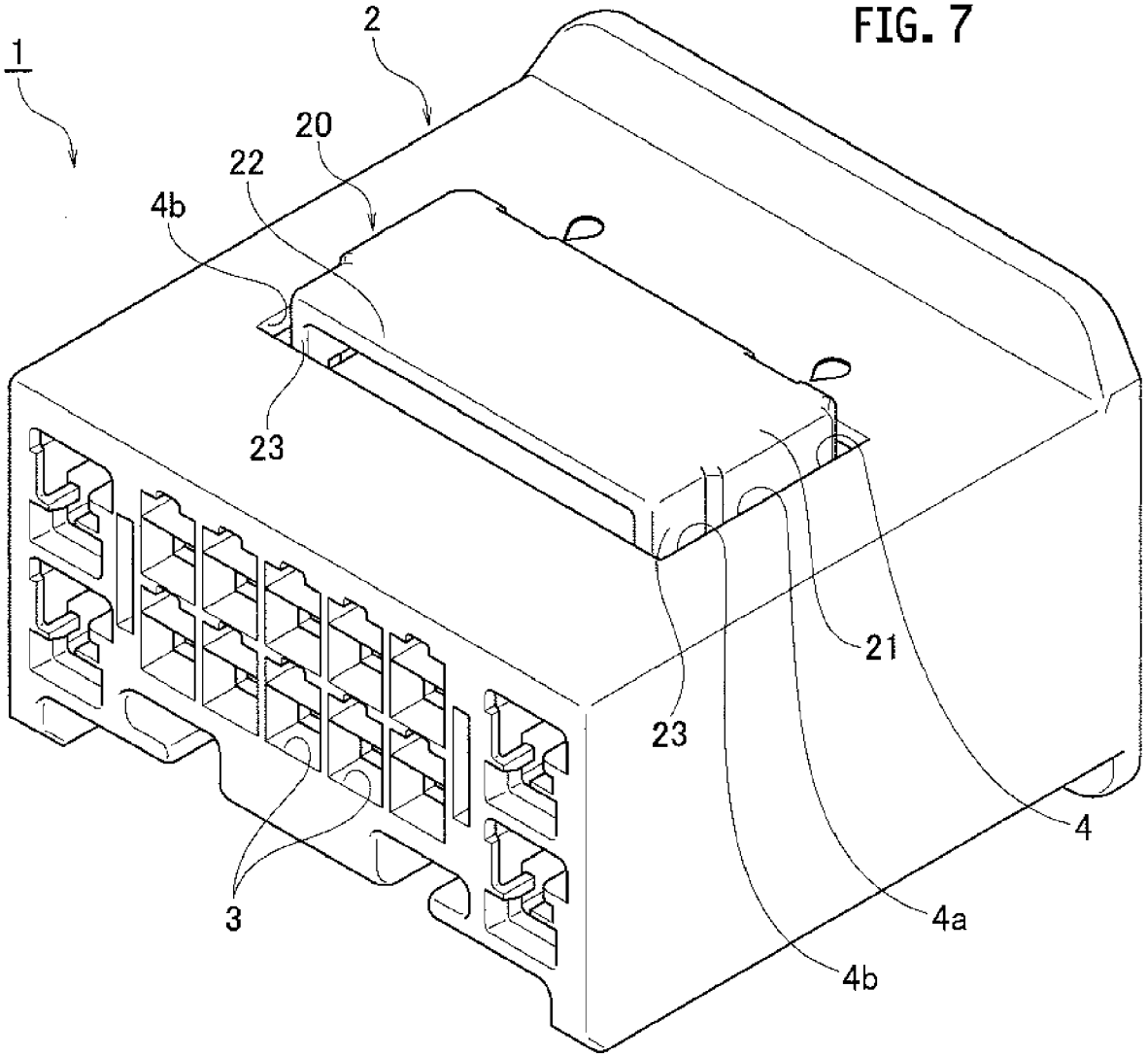
FIG. 7 illustrates the first embodiment of the present invention and is a perspective view of the connector in which the retainer is set in a provisional locking position.
Figure 8:
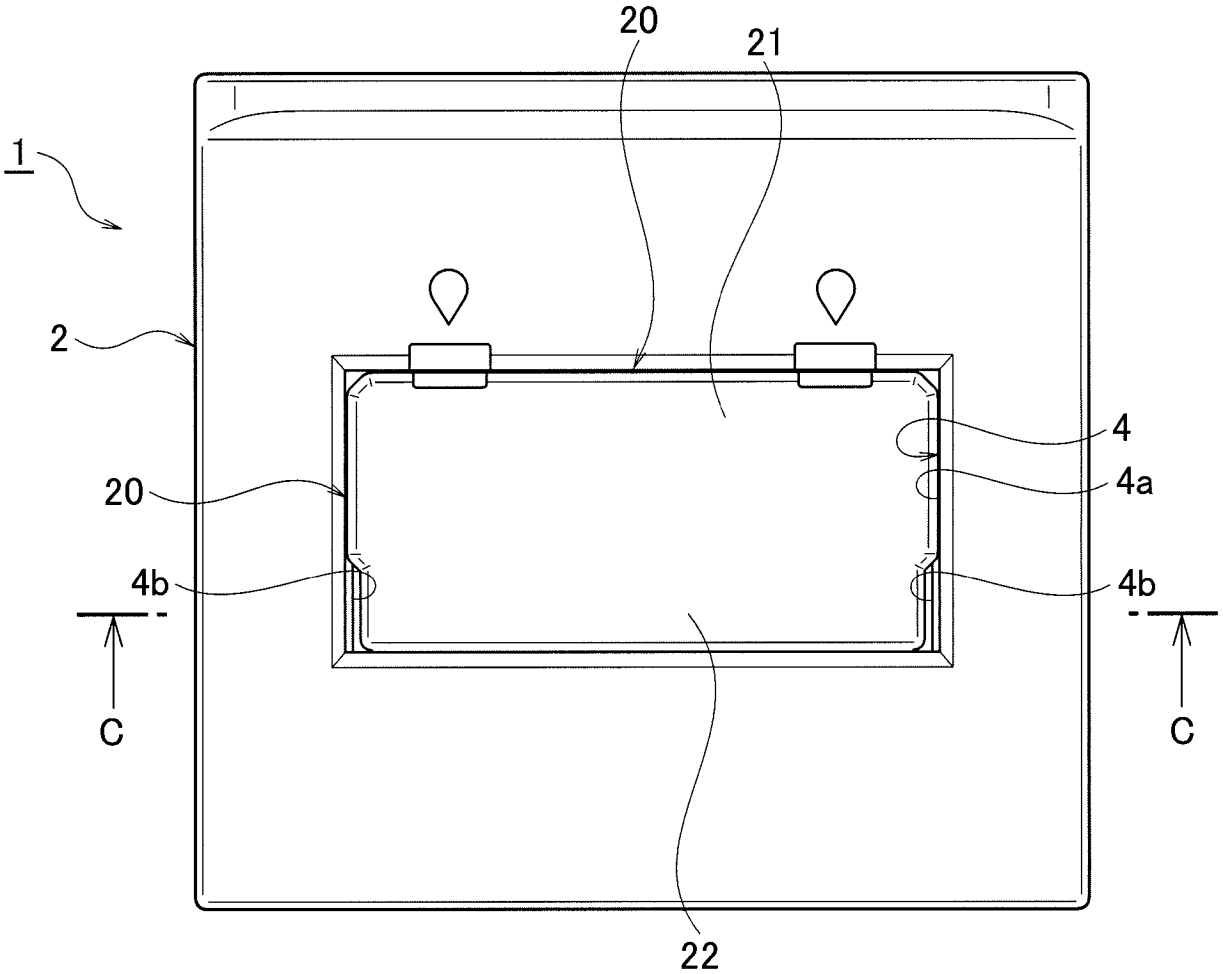
FIG. 8 illustrates the first embodiment of the present invention and is a plan view of the connector in which the retainer is set in the provisional locking position.
Figure 11:
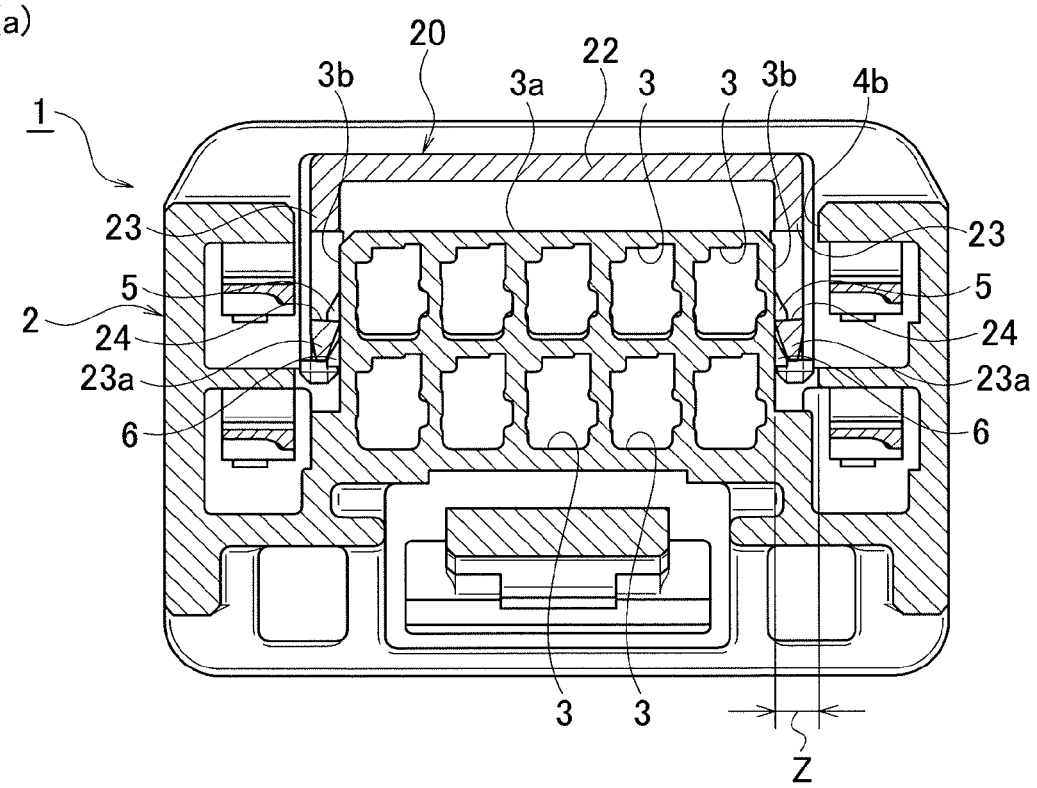
FIG. 11 illustrates the first embodiment of the present invention, where FIG. 11(*a*) is a cross-sectional view taken along line C-C of FIG. 8, and FIG. 11(*b*) is a cross-sectional view taken along line D-D of FIG. 10.
Figure 11:
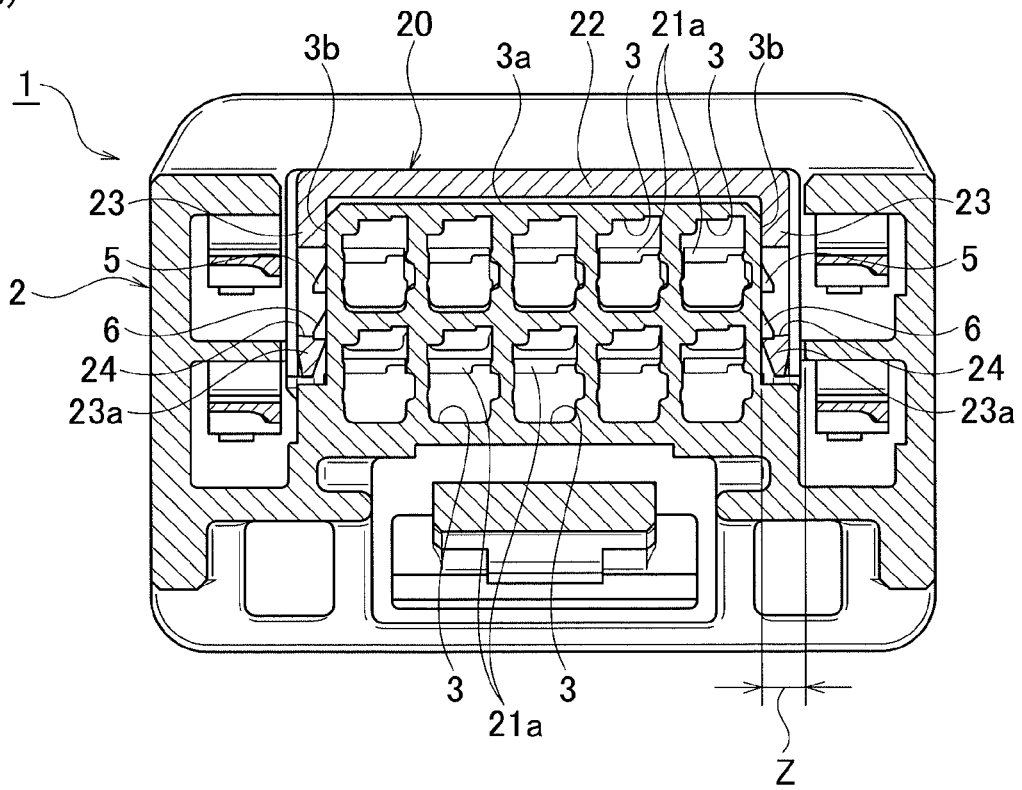

A procedure for attaching the terminals to the housing 2 will now be described. First, the retainer 20 is inserted into the retainer insertion hole 4 from above the housing 2. The retainer main body 21 and the top surface restricting wall 22 of the retainer 20 are inserted into the retainer main body insertion hole 4*a* and the pair of guide portions 23 of the retainer 20 is inserted into the pair of guide portion insertion holes 4*b*. During the insertion, first the insertion front end portions 23*a* of the pair of guide portions 23 of the retainer 20 interfere with the provisional locking projections 5 of the housing 2 but each guide portion 23 bends and deforms by a reactive force from each provisional locking projection 5 to allow the retainer 20 to be inserted. When the retainer 20 is inserted to a position where the insertion front end portions 23*a* of the pair of guide portions 23 of the retainer 20 override the provisional locking projections 5, the guide portions 23 bend and restore the deformation. Thereby, the provisional locking projections 5 of the housing 2 are locked in the locking holes 24 of the guide portions 23 of the retainer 20 as illustrated in FIGS. 7, 8 and 11(*a*) in an intermediate insertion position of the retainer 20. Thus, the retainer 20 is provisionally locked. At the provisional insertion position, the terminal locking portions 21*b* of the retainer 20 are located in the position before entering the terminal cavities 3.

Then, the terminals (not illustrated) are inserted into the terminal cavities 3. When the terminals (not illustrated) are fully inserted, the lances (not illustrated) prevent movement in the direction of detachment.

Figure 9:
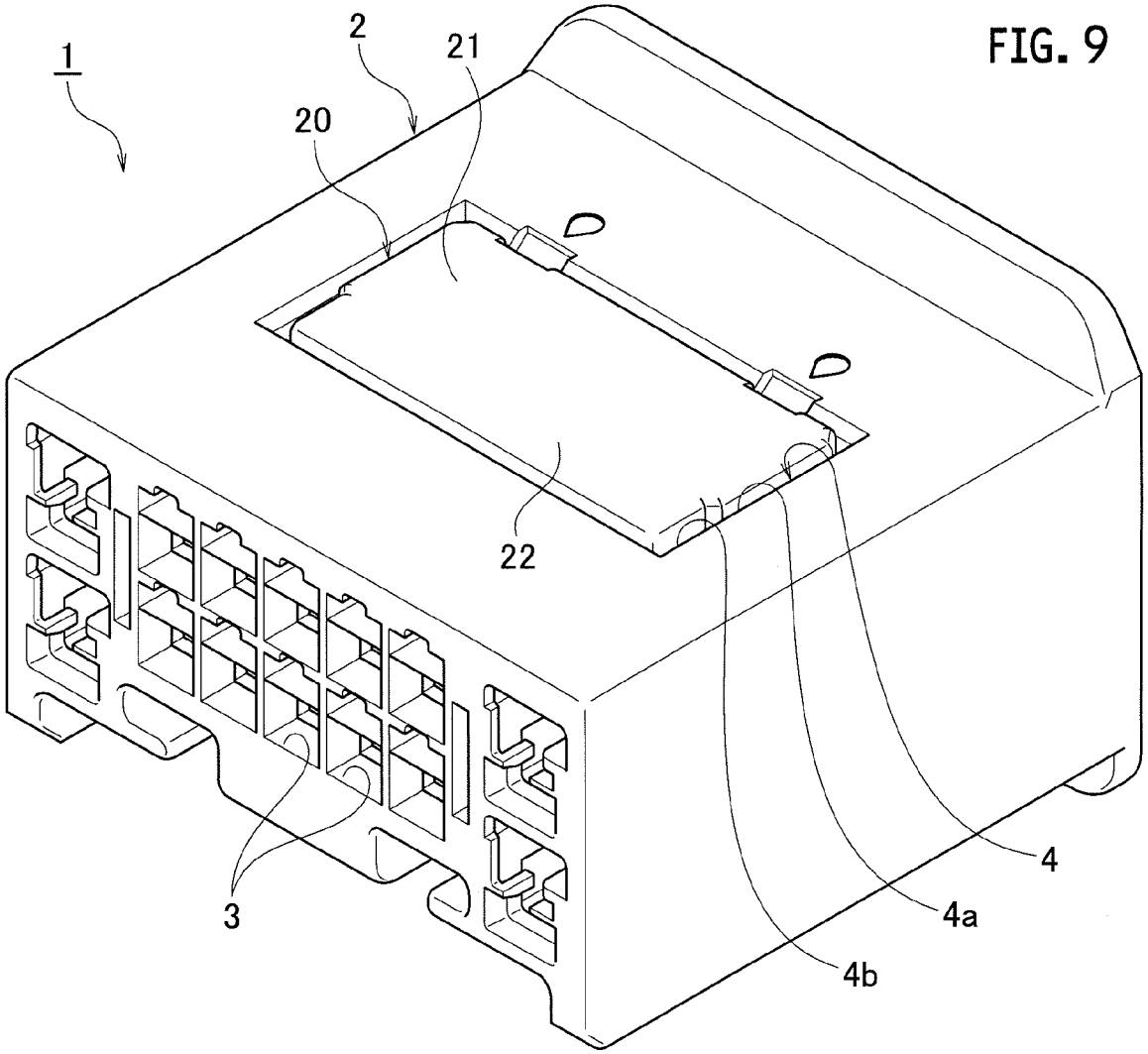
FIG. 9 illustrates the first embodiment of the present invention and is a perspective view of the connector in which the retainer is set in a final locking position.
Figure 10:
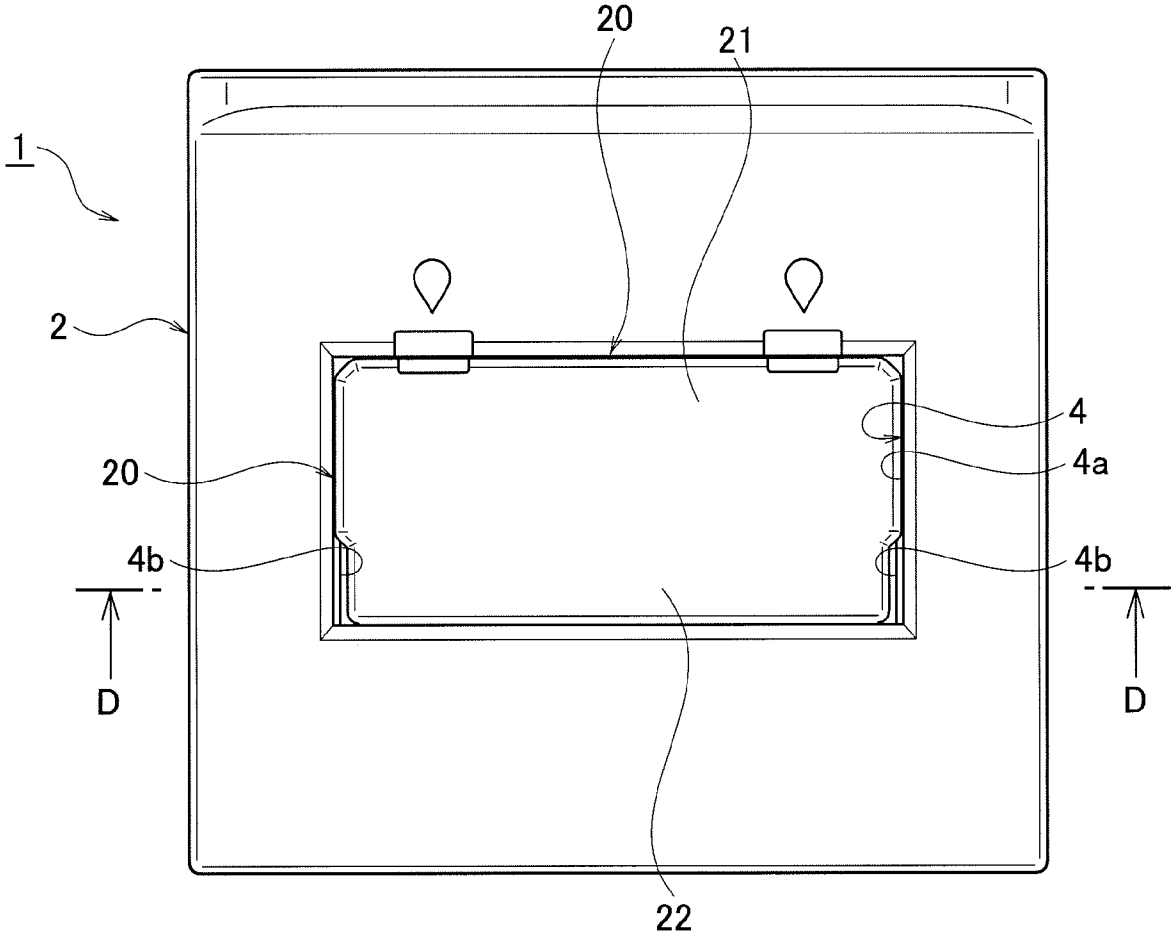
FIG. 10 illustrates a first embodiment of the present invention and is a plan view of the connector in which the retainer is set in the final locking position.

Then, the retainer 20 is inserted into the depth of the retainer insertion hole 4. The insertion front end portions 23*a* of the pair of guide portions 23 of the retainer 20 interfere with the final locking projections 6 of the housing 2, but each guide portion 23 bends and deforms by a reactive force from each final locking projection 6 to allow insertion of the retainer 20. When the retainer 20 is inserted to a position where the insertion front end portions 23*a* of the pair of guide portions 23 override the final locking projections 6, the guide portions 23 bend and restore the deformation. Thereby, the final locking projections 6 of the housing 2 are locked in the locking holes 24 of the pair of guide portions 23 of the retainer 20 as illustrated in FIGS. 9, 10 and 11(*b*) in an insertion completion position of the retainer 20. Thus, the retainer 20 is finally locked. At the final locking position, the terminal locking portions 21*b* of the retainer 20 enter the terminal cavities 3 to prevent the terminals (not illustrated) from moving in the direction of detachment. This completes the attachment of the terminals (not illustrated).

Since the terminals (not illustrated) accommodated in the housing 2 are doubly locked by the lances (not illustrated) and the retainer 20, the detachment of terminals (not illustrated) is reliably prevented.

As has been described above, the locked portions of the retainer 20 are formed by the locking holes 24 opened in the guide portions 23. Accordingly, only a minimum of bending deformation clearance that is equal to the thickness dimension W1 (illustrated in FIG. 6) of each of the guide portions 23 needs to be provided for the provisional locking projection 5 and the final locking projection 6. Thus, the bending deformation clearance can be made smaller by the size of the locking claw as compared with that of the conventional example. In other words, if the width of the bending deformation clearance for the guide portion 23, that is, the total of the length of the projecting portion of the provisional locking projection 5 and the final locking projection 6 and the thickness dimension of the guide portion 23 is equal to the width dimension Z of the guide portion insertion hole 4*b* (illustrated in FIG. 11), only a minimum of bending deformation clearance that is equal to the width dimension Z needs to be provided. Thus, a smaller bending deformation clearance than before can be chosen and consequently the size of the connector 1 can be made smaller.

Although the locking holes 24 are opened in the guide portions 23, a high stiffness is ensured by the double-supported beam structure. Therefore, the force to lock and hold the retainer 20 in the housing 2 does not decrease and consequently the retainer 20 can be prevented from moving or coming off due to vibrations during transportation of the connector or other causes.

The pair of bending deformation portions is the pair of guide portions 23 provided continuously to the retainer main body 21. Accordingly, the pair of guide portions 23 serves as both a guide and a locking structure to the retainer insertion hole 4 and consequently the configuration can be simplified. The guide portions 23 are provided continuous to the retainer main body 21 to provide a rigid structure, which also improves the force to lock and hold the retainer 20 to the housing 2.

(Modified Example of Retainer)

Figure 12:
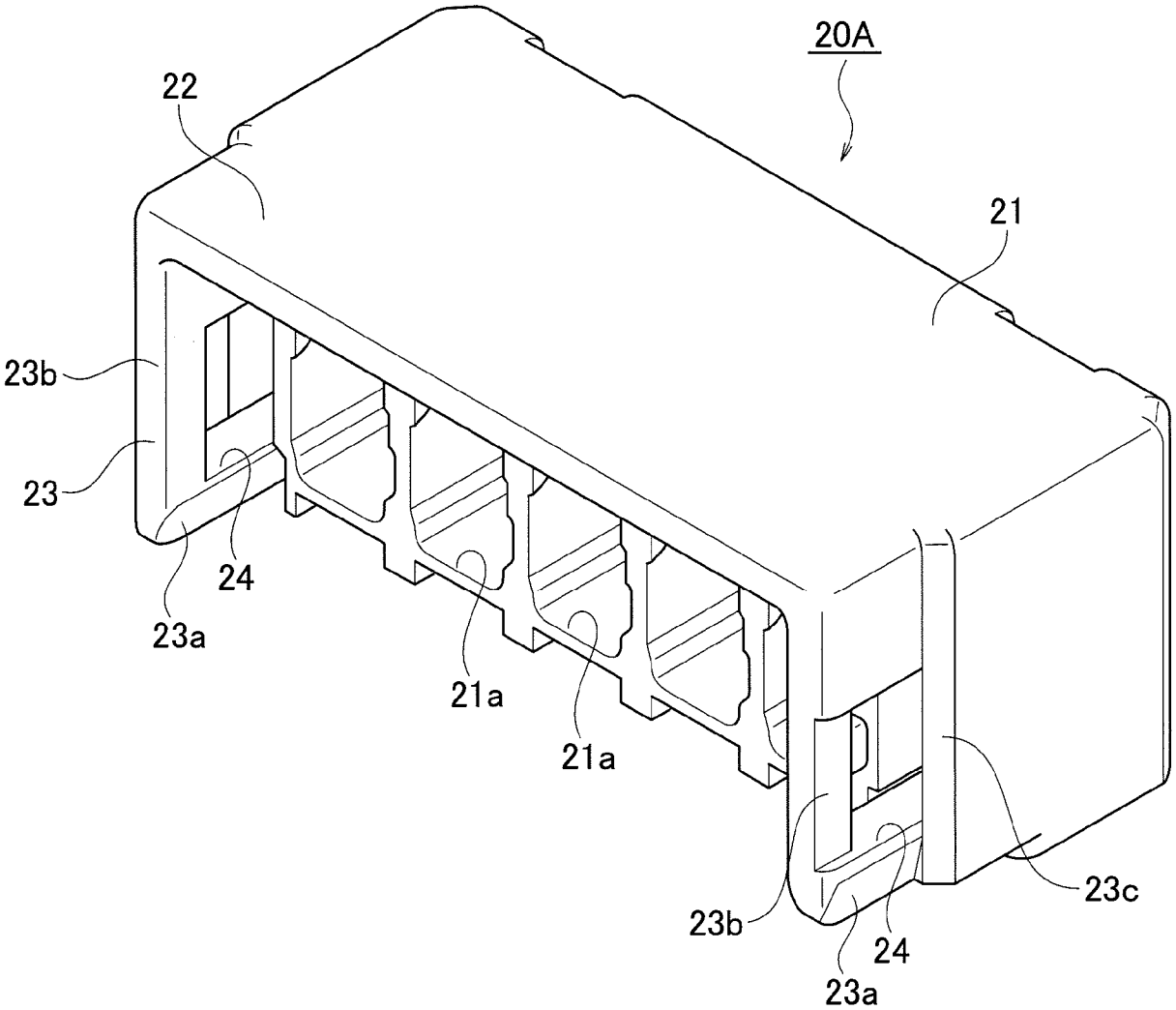
FIG. 12 illustrates a modified example of the present invention and is a perspective view of a retainer.
Figure 13:
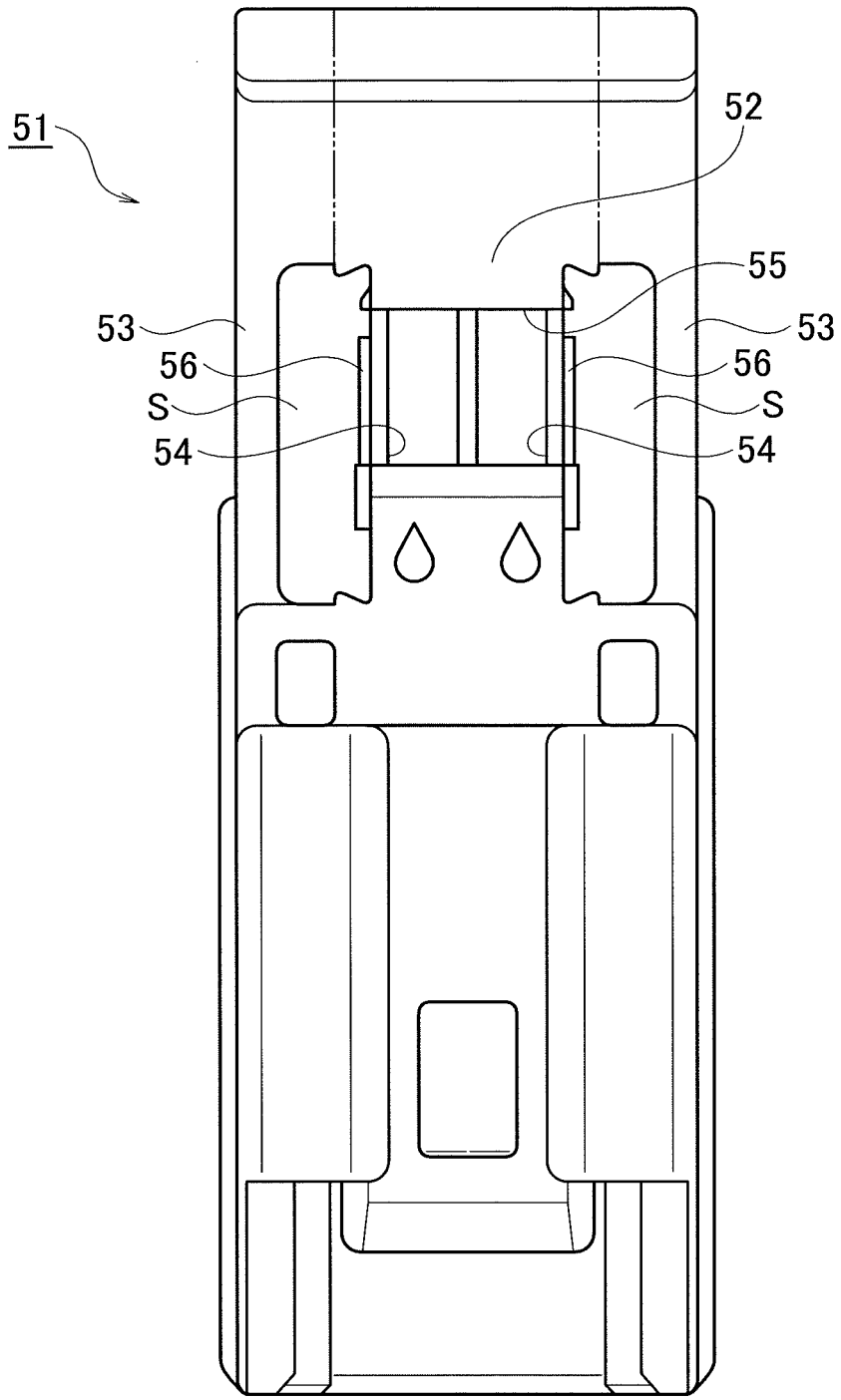
FIG. 13 illustrates an example of existing techniques and is a plan view of a housing.
Figure 14:
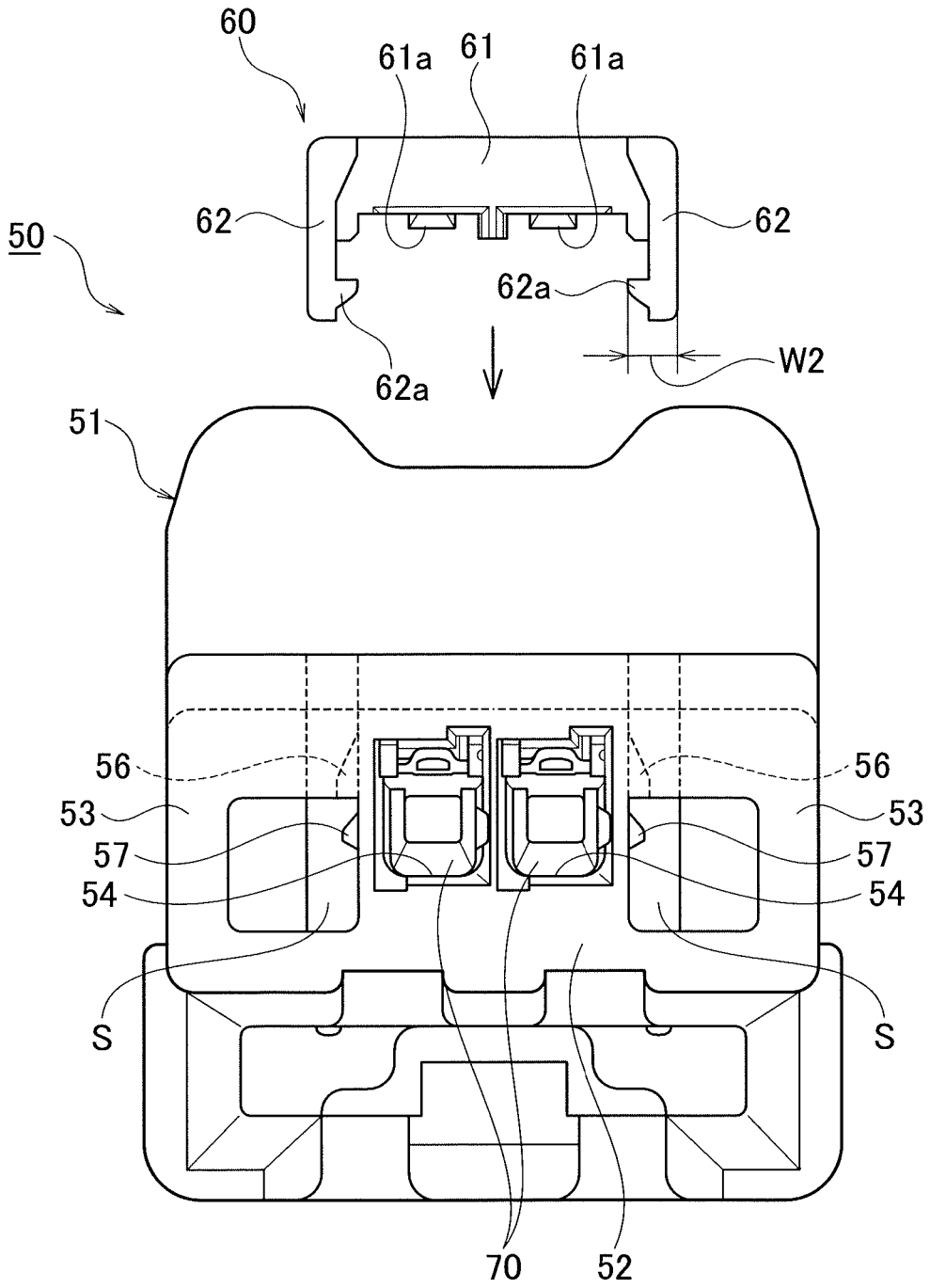
FIG. 14 illustrates the example of existing techniques and is a rear view illustrating a process of mounting the retainer to the housing and a state before the retainer is mounted.
Figure 15:
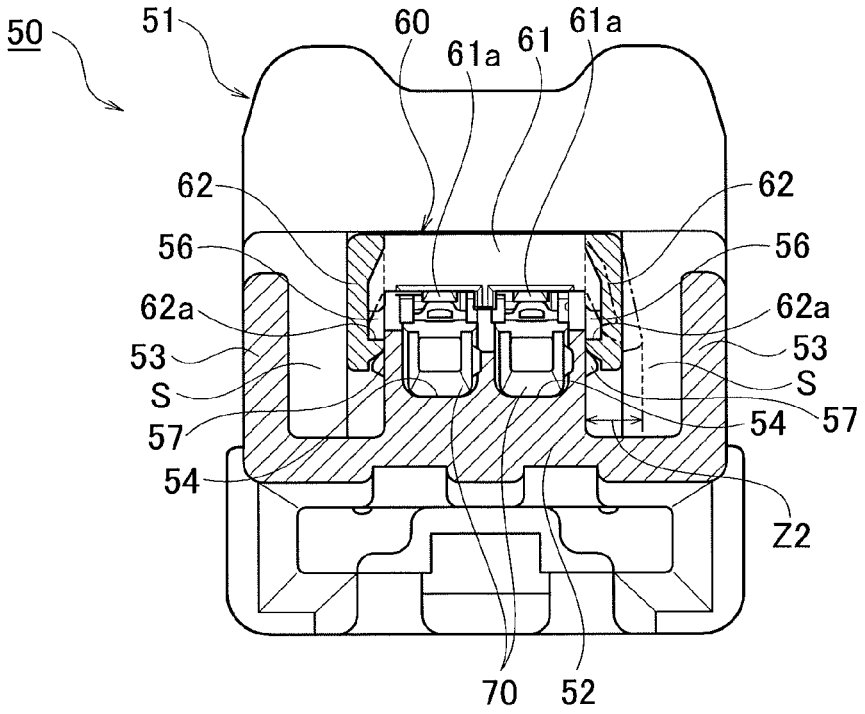
FIG. 15 illustrates the example of existing techniques and is a cross-sectional view illustrating the process of mounting the retainer in the housing and illustrating a state where the retainer is set in the provisional locking position.
Figure 16:
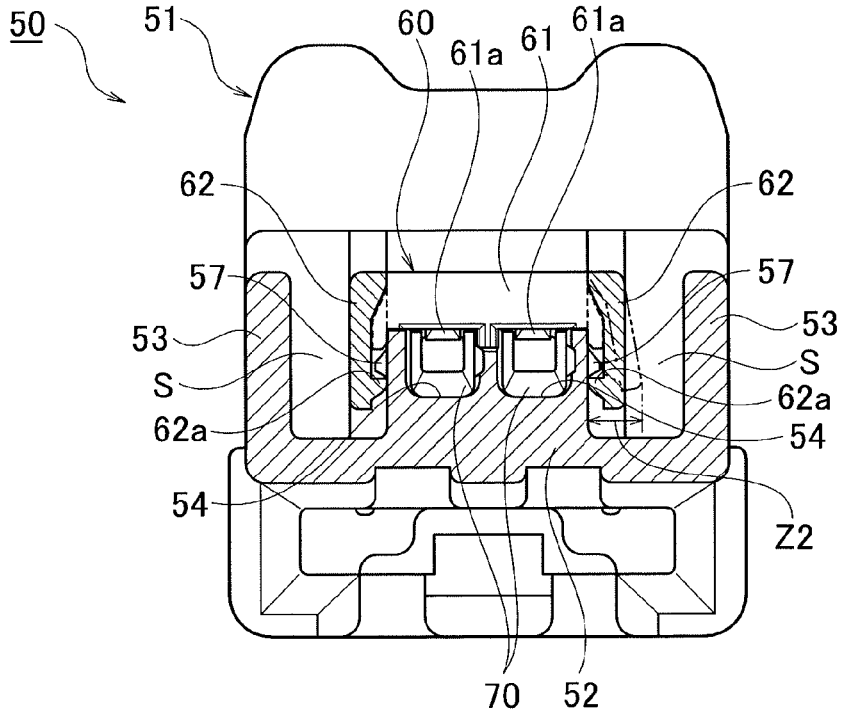
FIG. 16 illustrates the example of existing techniques and is a cross-sectional view illustrating the process of mounting the retainer in the housing and illustrating a state where the retainer is set in the final locking position.

FIG. 12 illustrates a modified example of the retainer 20. One of beam portions 23*b* surrounding the locking hole 24 of the retainer 20A is formed thinner than the other portions unlike in the retainer 20 of the embodiment described above. With this, the rigidity of the guide potions 23 is adjusted to fall within a desired range. In other words, the rigidity of the guide portions 23 can be readily adjusted with the ease of simply varying the thickness of the beam portions 23*b*. The thickness of the beam portions 23*b* can be adjusted simply by adjusting cutting of a mold.

The rest of the configuration is the same as the configuration of the embodiment described previously and therefore description of the rest of the configuration will be omitted. The same components in FIG. 12 as those of the embodiment described previously are given the same reference numerals for clarity.

This application is based upon and claims the benefit of priority from the prior Japanese Patent Application No. 2012-008833 filed on Jan. 19, 2012 and the entire contents of which are incorporated herein by reference.

INDUSTRIAL APPLICABILITY

According to the present invention, since the provisional locking projections and final locking projections are locked into the locking holes provided in the bending deformation portions, only a minimum of bending deformation clearance that is equal to the total of the projection dimension of the provisional locking projection and the final locking projection and the thickness dimension of the bending deformation portion needs to be provided and thus the bending deformation clearance can be made smaller than that of the conventional example. In this way, the bending deformation clearance in the container can be made smaller to reduce the size of the connector.

REFERENCE SIGNS LIST

1 Connector
2 Housing
4 Retainer insertion hole
4*a* Retainer main body insertion hole
4*b* Guide portion insertion hole
5 Provisional locking projection
6 Final locking projection
20, 20A Retainer
21 Retainer main body
23 Guide portion (Bending deformation portion)
23*b*, 23*c* Beam portion
24 Locking hole (Locked portion)

The invention claimed is:

1. A connector comprising:

a housing in which a terminal is accommodated, and a retainer which is mounted on the housing to prevent the terminal from moving in the direction of detachment, wherein a retainer insertion hole through which the retainer is inserted along an insertion direction, and a provisional locking projection and a final locking projection which project into the retainer insertion hole are provided in the housing, wherein the retainer includes a bending deformation portion which bends and deforms by interference with each of the provisional locking projection and the final locking projection, and a locked portion is provided in the bending deformation portion, wherein the locked portion and the provisional locking projection are locked together to be brought into a provisional locking state in an intermediate insertion position of the retainer into the retainer insertion hole, and the locked portion and the final locking projection are locked together to be brought into a final locking state in an insertion completion position of the retainer into the retainer insertion hole, and wherein wherein the locked portion is formed as a locking hole opened in the bending deformation portion.

2. The connector according to claim 1, wherein the bending deformation portion is a guide portion provided continuously to a retainer main body.

3. The connector according to claim 2, wherein in the guide portion, a beam portion surrounding the locking hole is formed thinner than the rest of the guide portion.

4. The connector according to claim 1, wherein the bending deformation portion is a pair of guide portions provided continuously to a retainer main body.

5. The connector according to claim 1, wherein the provisional locking projection and the final locking projection are successively provided along the insertion direction of the retainer.

* * * * *